United States Patent [19]

Gullas

[11] Patent Number: 4,725,386

[45] Date of Patent: Feb. 16, 1988

[54] METHOD AND APPARATUS TO MINIMIZE HARD-TO-REMOVE HUMIDIFIER DEPOSITS

[76] Inventor: Joseph G. Gullas, 3629 Brightway St., Weirton, W. Va. 26062

[21] Appl. No.: 29,674

[22] Filed: Mar. 24, 1987

[51] Int. Cl.[4] ..... B01F 3/04

[52] U.S. Cl. ..... 261/92; 210/696; 422/277; 261/DIG. 46

[58] Field of Search ..... 261/DIG. 46, 92; 422/277; 210/696, 698

[56] References Cited

U.S. PATENT DOCUMENTS

| | | | |
|---|---|---|---|
| 364,566 | 6/1887 | Avers et al. | 422/277 |
| 1,927,027 | 9/1933 | Foulds | 210/696 |
| 2,155,435 | 4/1939 | McCoy | 210/696 |
| 2,874,032 | 2/1959 | Kuehner | 261/DIG. 46 |
| 3,191,915 | 6/1965 | Goettl | 261/DIG. 46 |
| 4,420,463 | 12/1983 | Pocius et al. | 261/DIG. 46 |
| 4,519,914 | 5/1985 | Etani | 210/696 |
| 4,555,819 | 12/1985 | Weiss et al. | 422/277 |

*Primary Examiner*—Tim Miles

*Attorney, Agent, or Firm*—Raymond N. Baker

[57] ABSTRACT

Method and apparatus for preventing formation of hard-to-remove deposits when evaporating water e.g. on parts of water reservoir means used in humidifiers. A hollow, perforated confinement means is positioned in the water reservoir means to provide desired water access and contact with a mixture of a semi-solid, grease-like hydrocarbon which acts as a carrier for free metal or metal oxide in pulverant form such as copper powder, small flake aluminum, and zinc oxide.

9 Claims, 4 Drawing Figures

FIG. 1
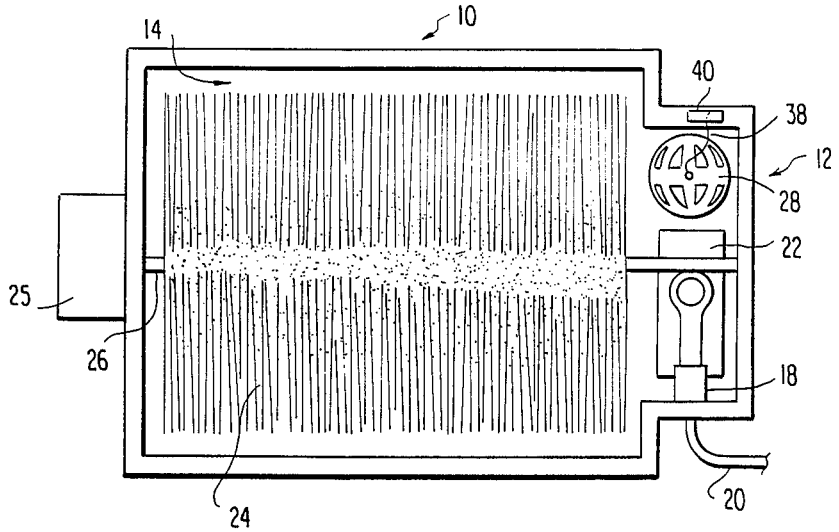
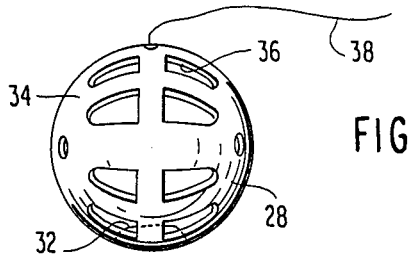
FIG. 2
FIG. 3
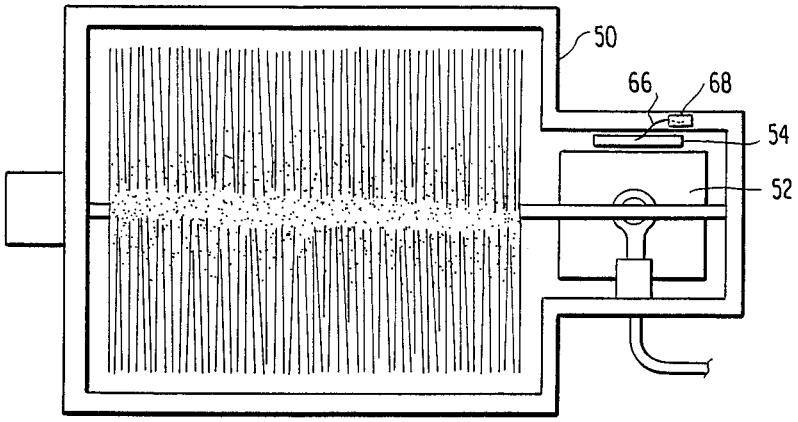
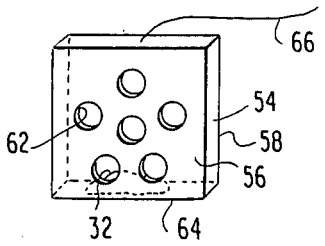
FIG. 4

METHOD AND APPARATUS TO MINIMIZE HARD-TO-REMOVE HUMIDIFIER DEPOSITS

The present invention relates to a method and apparatus for preventing formation of hard-to-remove deposits when evaporating water; for example, for preventing hard-to-remove deposits on walls of a water reservoir or other parts of furnace humidifiers.

Various types of furnace humidifiers are known for adding moisture to the atmosphere of homes and other establishments. In a common type of evaporative humidifier, a drum or disk component, partially submerged in water in the reservoir, is rotated while forced air, or convection current of air from the furnace moves through the component. Other furnace humidifiers use rotating brush or stationary plate components which conduct the moisture into the path of an air stream. In such humidifiers, a float valve usually adds water to the reservoir as evaporation occurs, to maintain a constant or predetermined water level in the reservoir.

The evaporation causes minerals and other impurities in the water fed to the reservoir to increase in concentration and form hard deposits on the walls of the reservoir as well as on the humidifier components in the reservoir, including the float and valve parts.

Deposits on humidifier parts can vary depending on the region of the country and the mineral content of the water; and, can be very difficult to remove. Such deposits must often be scraped or sanded which is difficult and time-consuming. While chemical solutions have been recommended for removing such hardened scale, their effectiveness and practicality remain questionable; some are dangerous for the inexperienced homeowner to use, and may not be available through ordinary consumer channels for humidifier supplies.

Timer actuated drain valves have been used in the past to drain the reservoir at intervals of perhaps every twenty-four hours in an endeavor to diminish concentration of the minerals and resulting deposits. These automatic drain arrangements, however, require electrical controls for the timer, and special drain plumbing. Another disadvantage of such drain systems is the cost since considerable water is wasted, and timing circuitry or mechanisms can be expensive.

Other approaches attempting to decrease the scale build-up problem include use of water softeners or deionizers which help to remove portions of the minerals from the water before being fed into the reservoir; such equipment is quite expensive and requires backflow or similar cleaning, at predetermined intervals, depending on the amount of water used; and, also, special drain plumbing.

However, unless a humidifier is periodically serviced and the deposits removed, the deposits can become sufficiently thick to hinder rotation of the evaporative means, or clog porous surfaces of such means, or otherwise reduce the efficiency or operation of the humidifier.

An important contribution of the invention is minimizing the tendency for the water in the reservoir to form hard-to-remove deposits in the first place so as to eliminate the scale removal and other problems of the prior art.

In accordance with the invention deposits are minimized by providing for suspending in the humidifier water, so as to be readily accessible to contact with the water, a small quantity of a substance comprising a semi-solid hydrocarbon uniformly mixed with free metal in pulverant form. This combination of a hydrocarbon carrier and pulverant metal is suspended in a manner to provide desired water access.

A small quantity of such uniformly mixed petroleum-based grease and pulverant metal, particularly copper, placed in a perforated container which enables contact of such contents with the water in the reservoir, without permitting the contents in the form initially provided to flow out of or to be readily removed from the container by the water access, provides unexpectedly and excellent results. Any need for cleaning an average home humidifier more than every several months, or once a season, is eliminated. And, when undertaken, easy and thorough cleaning of the reservoir, as well as the humidifier components in the reservoir with readily available detergents or similar household-type cleaners, can be readily accomplished.

The perforated container can be of any convenient shape, such as spherical, cylindrical, or flat. A plastic is used which is rigid and will hold its shape over a normal range of temperatures (e.g. 50° F. to 110° F.) and which is non-reactive. The container is perforated over about one-fourth of its surface area to provide open access to the water. The container is made or assembled so that it can be attached by a cord, with tape or hook means, over the edge of the reservoir to suspend the container and its contents in the reservoir at a location where it does not interfere with any rotating parts, or operation of the float The nature of the container and its contents are such that each has good shelf life; can be marketed using conventional non-porous wrapping materials; the contents are resistant to flowing or seeping at normally encountered shelf or shipping temperature extremes of up to about 130° F.; and, neither container nor contents fumes significantly when immersed in water. While a petroleum-like odor may be detected on close inspection of the substance, the container with the combination of ingredients placed therein is relatively odor free during usage. The entire unit, container and contents, is easy to use; the homeowner need only remove the outer wrapping and hang the unit in the humidifier with the contents at least partially submerged in the reservoir water.

In accordance with a preferred embodiment of the invention, the confined contents are of sufficient quantity to treat humidifier reservoir water for an entire humidifying season of about six to eight months.

These and other contributions or advantages of the invention will be discussed in more detail in reference to the accompanying drawings, in which:

FIG. 1 is a top plan view of humidifier structure for practice of the method of the invention and shows one form of the container-substance unit of the invention in place in such humidifier structure;

FIG. 2 is an enlarged pictorial view of the container-substance unit of FIG. 1;

FIG. 3 is a top plan view of another humidifier structure showing a different shape of container-substance unit in place; and FIG. 4 is an enlarged pictorial view of the container-substance unit of FIG. 3.

FIG. 1 shows humidifier structure 10, with its cover removed, having a typical housing 12 with side and bottom walls which define a water reservoir 14. Water within reservoir 14 is maintained at a predetermined level of perhaps several inches, for example by a valve 18, connected in a water line 20, and operated by a float 22.

A humidifier evaporative component in the form of a cylindrical brush 24 is partly submerged in the reservoir water, and is slowly rotated by a motor 25 which drives the brush shaft 26, so that the unsubmerged portions of the brush are maintained moist to add moisture to forced or convection currents of air which flow through the humidifier in a known manner. Water evaporated from the reservoir 14 is replenished by the valve 18.

In prior practice, the evaporation of water from the reservoir caused minerals and other impurities in the water fed to the reservoir to increase in concentration and form hard deposits on the walls of the reservoir, as well as on the humidifier components having contact with the reservoir water including the float 22, valve 18, and brush component 24.

In the past, such deposits could become sufficiently thick to hinder rotation of and deform the bristles of brush 24 or similar evaporative means, or clog porous surfaces of such means, thus reducing efficiency of the humidifier. Also, deposits which formed on the valve 18 or float 22 could increase the water level in the reservoir resulting in overflow or leaking.

In accordance with the invention these problems are essentially avoided by preventing the reservoir water and minerals and impurities therein from forming hard deposits.

As shown at FIG. 1, this is accomplished by placing in the water in the reservoir 14, a substance-confinement unit in which the container is in the form of a hollow, perforated ball or sphere 28. As shown at FIG. 2, the ball 28 contains contents 32. In accordance with the invention, a mixture of ingredients comprising a semi-solid hydrocarbon uniformly mixed with free metal in pulverant form is held within the perforated container.

The substance 32 has the consistency of a heavy grease and adheres to the inner surface of the ball 28. The ball 28 has a thin outer wall 34 with water access openings or perforations 36 distributed about its surface so that reservoir water can move into and out of the ball in contact with the confined substance 32. A cord 38 connected to ball 28 is fastened to the side wall of the reservoir 14 with an adhesive strip or tape 40. Other means can be used to maintain the ball in a desired position in the reservoir where it does not interfere with the rotation of the brush or the operation of the float 22 and valve 18 but has contact with reservoir water.

The water access perforations 36 occupy about one-fourth of the surface area of the ball 28, which is about one and one-half inches in diameter. It can be theorized that such access helps to maintain a desired level of saturation of the combined ingredients in the water. However, the functioning of the contents is not dependent on mechanically breaking up the suspended material into particles. The desired saturation of effective ingredients in the water solution seems to occur even though physical dissipation is not readily apparent from visual observation over a period of several months' usage in an average home furnace humidifier.

The ball 28 should be of material(s) which are non-reactive with the reservoir water or container contents. A plastic such as polyethylene, or polypropylene, is preferred since these are non-toxic at usual furnace temperatures, and are materials which can be safely used in a humidifier. The confinement means should have a density so that the ball with contents does not tend to float in water.

The substance 32 can be a hydrocarbon lubricating compound having the consistency of a heavy grease mixed with pulverant metal and metallic compounds. A grease of suitable consistency is the type used to prevent seizing of fastener threads subjected to moderately high temperatures. It has been found that a high quality wheel bearing grease acting as a carrier and uniformly mixed with graphite powder, pulverant copper, small flake aluminum, and zinc oxide, or selected other metal powders and oxides, is effective in preventing hard deposits. Typical formulations include, by weight, about fifteen to twenty-five parts graphite powder, about ten to twenty parts copper powder, about one to five parts small flake aluminum, and about one to five parts zinc oxide, intimately mixed with wheel bearing grease to form one hundred parts by weight. In its mixed form, the substance 32 can exhibit a density more than about twice the density of water, and thus does not tend to cause the container to float.

It has been found that only about five grams, of such substance 32, in a container such as ball 28 which permits the reservoir water to contact the substance, is required to prevent hard-to-clean deposits on surfaces of the reservoir and the humidifier components in the reservoir, for the usual season of use of a humidifier of six to eight months; such specific embodiment contained by weight about 20% graphite powder, about 15% pulverant copper, about 2.5% small flake aluminum, about 2.5% zinc oxide, and the balance heavy grease.

The ingredients used are non-toxic and the amount of grease is relatively small so that it presents no real fire hazard, even if the water to the reservoir is shut off and the reservoir becomes dry. Suitable ingredients can be mixed or have been found in commercially available anti-seizing compounds which use a mixture of pulverant metals and metallic compounds.

In practice for use with an average home-sized humidifier, about five grams of the mixture 32 is applied to the inside surface of the lower portion of a perforated ball 28 having a string 38 connected to its upper end. The ball is placed in the reservoir of a humidifier and the string is fastened with tape or otherwise to tether the ball. The humidifier can be operated for about six months without any cleaning, maintenance, or draining of reservoir water. A "Regular Grade, anti-seize and lubricating compound" sold under the trademark NEVER SEEZ is a specific example.

In specific runs, the humidifier was then opened and the ball 28 was removed and inspected. There was no perceptible decrease of the small quantity of the substance 32 initially placed in the ball. The water in the reservoir can be quite discolored, and appear to contain a high concentration of minerals and impurities. A faint petroleum odor can be observed. Any film observed on the reservoir walls, particularly at the water line, is soft and could be said to have emulsion characteristics; the same was observed for deposits on the brush and float.

No chemical analysis was conducted; however, all deposits were found to be relatively soft and could be wiped off with a cloth. The deposits on the reservoir and brush were easily removed by washing with a household detergent. Deposits on the shaft of the brush when allowed to dry partly flaked off. Light impacts on the shaft caused the remaining deposits to fall off. After such cleaning, the brush was observed to be free of deposits and to have its original shape, and the reservoir, float, and valve were all free of deposits.

In contrast, a humidifier of the same type operated under similar conditions for the same length of time, but without the ball 28 and substance 32 in its reservoir, had heavy deposits on all the reservoir surfaces. The brush shaft was coated with deposits, and the bristles were also coated and deformed. The deposits were hard, cement-like and could not be removed by soaking followed by scrubbing with a strong detergent solution. Scraping and sanding were required to remove the heavier deposits, but neither the brush nor the reservoir could be completely cleaned. While some of the deposits could be removed from the brush, the bristles remained so deformed and bent that they rubbed against the end of the reservoir, and it was felt necessary to replace the brush.

While it is known that the substance 32 works, how it works to prevent hard-to-remove deposits from forming cannot be wholly explained at this time. It can be theorized that the grease releases some oil which partially emulsifies to form a protective film; and also that the metal powders, particularly the copper powder, in some way combine physically with the minerals or impurities which concentrate in the water to form minute particles which become coated with an emulsified lubricating film that prevents the particles from firmly adhering to the component surfaces.

Whatever the mechanism, it is known that this substance when used as indicated above, prevents the forming of hard-to-remove deposits on the humidifier components.

While a spherical shape is preferred, where the humidifier is of such construction that there is only a small space available in the reservoir between the reservoir walls and the moving humidifier parts, the container can take the form of an essentially flat packet.

In some humidifier structures, such as the humidifier structure 50 of FIG. 3, the float 52 approximates the size of the float chamber, and there is only a small cross-sectional space available in the reservoir where a container-substance unit can be placed without interfering with the float or the evaporative component; e.g. a space not sufficient to accommodate the ball 28. For such a humidifier, a flat packet or container 54 can be used. A thin container, only about ⅜ inch thick as measured between its major front and rear side walls 56 and 58, can be adequate. Container 54 is rectangular, and has openings 62 in its side walls 56, 58, so that the water in the reservoir can contact the small amount of the substance 32 (FIG. 4), applied to the inside surface of bottom wall 64. The container 54 can be of a plastic material of the type previously described for the ball 28, or can be of other material, and is sufficiently narrow to be placed either beside or under the float, where it can be held by a tether string 66 secured to the reservoir wall with an adhesive tape 68; or directly with a suitable adhesive tape.

It is preferred that the container-substance unit have a density greater than water so the unit will not tend to float to the surface of the water in the humidifier reservoir.

While specific materials and dimensions for a preferred method and apparatus according to the invention have been shown and described, changes therein can be made in the light of such teachings; therefore, for purposes of determining the scope of the invention, reference shall be had to the appended claims.

I claim:

1. Apparatus for preventing hard-to-remove deposits within a water-containing reservoir of a humidifier comprising, a mixture combining a carrier material in the form of a semi-solid hydrocarbon and uniformly distributed pulverant-form free metal, means for suspending a predetermined amount of such mixture in such reservoir at least partially submersed in water within such humidifier reservoir, including a hollow confinement means having an outer surface defining a configuration enabling it to be at least partially immersed in water within such humidifier reservoir, such predetermined amount of mixture being held by such confinement means at least partially within such outer surface, such confinement meahs outer surface having perforations of a size to provide water access to the interior of such confinement means for solution contact with such mixture of hydrocarbon carrier and pulverant metal, and means for attaching such confinement means to such reservoir.

2. The apparatus of claim 1 in which such pulverant free metal comprises copper up to about 15% by weight of such mixture.

3. The apparatus of claim 1 in which such pulverant metal comprises copper, and wherein said mixture further contains zinc oxide powder.

4. The apparatus of claim 3 wherein said mixture further contains small flake aluminum and graphite powder.

5. The apparatus of claim 1 in which such hollow perforated surface confinement means holds about five (5) grams of such mixture of which about 15% by weight is pulverant copper.

6. The apparatus of claim 1 in which such hollow confinement means is formed from a relatively rigid plastic material with such water access perforations occupying about one-fourth of the surface area of such confinement means, and in which such plastic material is essentially non-reactive with such humidifier water or such confined mixture.

7. A method of preventing hard-to-clean deposits on surfaces within a water-containing reservoir of a humidifier comprising providing a perforated confinement means, providing a mixture of a grease-like, semi-solid hydrocarbon and pulverant form free metal, placing a predetermined amount of such mixture within such confinement means, positioning such perforated confinement means in such reservoir so as to provide water access to the interior of such confinement means to enable solution contact of at least a portion of such hydrocarbon and free metal with such humidifier water.

8. The method of claim 7 in which such pulverant metal comprises copper.

9. The method of claim 7 in which such pulverant metal comprises copper, and said mixture further contains zinc oxide in pulverant form.

* * * * *